US005338039A

United States Patent [19]

Oka et al.

[11] Patent Number: 5,338,039

[45] Date of Patent: Aug. 16, 1994

[54] GOLF BALL

[75] Inventors: Kengo Oka, Kobe; Shinji Ohshima, Akashi, both of Japan

[73] Assignee: Sumitomo Rubber Industries, Ltd., Hyogo, Japan

[21] Appl. No.: 958,164

[22] Filed: Oct. 8, 1992

[30] Foreign Application Priority Data

Oct. 8, 1991 [JP] Japan ..... 3-260355

[51] Int. Cl.[5] ..... A63B 37/14

[52] U.S. Cl. ..... 273/232

[58] Field of Search ..... 273/232, 220, 62; 40/327

[56] References Cited

U.S. PATENT DOCUMENTS

| | | | |
|---|---|---|---|
| 1,418,220 | 5/1922 | White | 273/232 |
| 4,090,716 | 5/1978 | Martin et al. | 273/232 |
| 4,869,512 | 9/1989 | Nomura et al. | 273/232 |
| 4,991,852 | 2/1991 | Pattison | 273/232 |

FOREIGN PATENT DOCUMENTS

| | | | |
|---|---|---|---|
| 2143397 | 12/1973 | France . | |
| 648982 | 1/1989 | Japan . | |
| 323184 | 3/1991 | Japan . | |
| 2215620 | 9/1989 | United Kingdom | 273/232 |
| 2242363 | 10/1991 | United Kingdom . | |

*Primary Examiner*—George J. Marlo

[57] ABSTRACT

A golf ball having a plurality of dimples on a surface thereof characterized in that more than 40% of all dimples are polygonal in shape and have a double slope in section having a straight first slope and a straight second slope continued radially inwardly from the first slope, and the gradient of the first slope of said double slope disposed in the vicinity of a dimple edge is greater than that of the second slope disposed in the vicinity of the bottom thereof.

5 Claims, 26 Drawing Sheets

GOLF BALL

BACKGROUND OF THE INVENTION

1. Field of the Invention

The present invention relates to a golf ball and more particularly to configuration improved dimples to make the flow of air in the periphery of the golf ball turbulent during the flight thereof so as to improve the aerodynamic performance of the golf ball.

2. Description of the Related Arts

The golf ball has normally 280 to 540 dimples formed on a spherical surface so as to depress radially inwardly from the spherical surface. The role of the dimple is to reduce pressure drag to the golf ball and improve the dynamic lift thereof. More specifically, in order to lift the golf ball high in the air during the flight of the golf ball, it is necessary to switch the separation point between the air and the upper surface of the golf ball to a rearward point with respect to the separation point between the air and the lower surface thereof. Thus, the air pressure above the golf ball can be made to be smaller than that below it. In order to accelerate the separation of the air existing above the golf ball from the upper surface thereof. it is necessary to make the air current around the golf ball turbulent. In this sense. It can be said that the dimple capable of making the air flow in the periphery of the golf ball very turbulent is aerodynamically superior.

In view of the role of the dimple, proposals regarding the combination of dimples in various configurations formed on the surface of the golf ball to make the flow of the air in the periphery of the golf ball turbulent. For example, Japanese Patent Laid-Open Publication No. 48-19325 discloses dimples pentagonal or hexagonal in the surface configuration thereof. According to examined Japanese Patent Publication No. 3-23184, a dimple has two different curvatures (double radius) in the sectional configuration thereof. According to Japanese Patent Laid-Open Publication No. 64-8982, dimples comprise circular dimples and uncircular dimples.

The dimples of the above-described proposals do not have the effect of making the air flow in the periphery of the golf ball turbulent to a great extent. Thus, the flight distance of the golf balls having the dimples according to the proposals is not as desired.

SUMMARY OF THE INVENTION

It is an object of the present invention to provide a golf ball having configuration improved dimples to make an air flow in the periphery of the golf ball very turbulent so as to improve the flight distance of the golf ball.

In accomplishing these and other objects of the present invention, there is provided a golf ball having a spherical surface and including a plurality of dimples defined on the spherical surface so as to depress radially inwardly from the spherical surface, in which more than 40% of all dimples has a polygonal in the surface configuration thereof delimited by a double slope comprising of first slope walls inclined at a first predetermined angle and second slope walls continued radially inwardly from the respective first slopes and inclined at a second predetemined angle, the first slope is positioned adjacent the spherical surface and the second slope is positioned on one side of the first slope remote from the spherical surface, the first predetermined angle is greater than the second predetermined angle. That is, more than 40% of all dimples is the polygonal dimple which has the double slope in section, and the gradient of the first slope of the double slope disposed in the vicinity of the dimple edge is greater than that of the second slope disposed in the vicinity of the bottom thereof.

The above-described "surface configuration" of the dimple means the configuration of the dimple viewed in the direction from a normal line of the spherical surface of the golf ball. The "double slope" means that as shownby a solid line of FIG. 1, the sectional configuration of the dimple in the range from a dimple edge (a) to the center (b) of the dimple is composed of two straight lines (c) and (d), the gradient of which are different from each other. The straight line (c) near the dimple edge (a) is referred to as a first slope and the straight line (d) near the dimple bottom is referred to as a second slope.

In a limited range of the dimple volume, the configuration of the double slope of the dimple is set to satisfy the following three conditions to increase the effect of sweeping air away from the periphery of the golf ball.

Firstly, referring to FIG. 1, supposing that the gradient of the first slope (c) is $\theta 1$ and the gradient of the second slope is (d) is $\theta 2$, $\theta 1 > \theta 2$.

Secondly, supposing that the horizontal length between the vertex (a) of a polygonal dimple and the center (b) thereof is L1; and the horizontal length between the intersection (e) of a first slope (c) with a second slope (d) and the center (b) of the regular pentagon is L2; $L2/L1 \leqq 0.6$.

Thirdly, supposing that the distance between the imaginary spherical surface of the golf ball and the deepest point of the dimple is F1; the vertical length between the imaginary spherical surface of the golf ball and the intersection (e) of the first slope (c) with the second slope (d) is F2; and the radius of golf ball is R, the following equation is established:

$$\{F2-R+(R^2-L1^2)^{178}\}/\{F1-R+(R^2-L1^2)^{\frac{1}{2}}\} \geqq 0.6$$

The sides of the polygonal dimple are curved because the surface of the golf ball is curved and hence the surface configuration of the dimple is not polygonal in a strict sense. According to the present invention, such a surface configuration is regarded as approximately polygonal and called a polygonal dimple.

As described above, the dimple according to the present invention is polygonal in its surface configuration and has a double slope. The polygonal configuration has a function of making an air flow turbulent. The double-slope configuration of the dimple allows the gradient of its first slope to be larger than the gradient of the single-slope configuration conventionally adopted, as shown by a broken line (g) of FIG. 1, supposing that the dimple volume of the double slope configuration is equal to that of the single-slope configuration. That is, the plane (surface of first slope) having a great angle with respect to an air flow can be formed in continuity with the dimple edge. Thus, the double-slope configuration has the effect of sweeping air away from the periphery of the golf ball. That is, the air in the periphery of the golf is made to be turbulent by the polygonal configuration of the dimple and swept away from the golf ball by the double-slope configuration. Thus, the dimple polygonal and doubly sloped increases the aerodynamic characteristic of the golf ball.

According to the golf ball of the present invention, the golf ball has dimples in the above-described configuration at more than 40% of all dimples. Therefore, the golf ball has an improved flight performance and hence a long flight distance. Experimental researches have indicated that the golf ball having dimples polygonal and doubly sloped at less than 40% of all dimples formed on the surface thereof does not have an improved flight performance and thus does not fly as long as the golf ball having dimples polygonal and doubly sloped at more than 40% of all dimples thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become clear from the following description taken in conjunction with the preferred embodiments thereof with reference to the accompanying drawings which are given by way of illustration only, and thus are not limitative of the present invention, and in which.

DETAILED DESCRIPTION OF THE INVENTION

Figure 1:
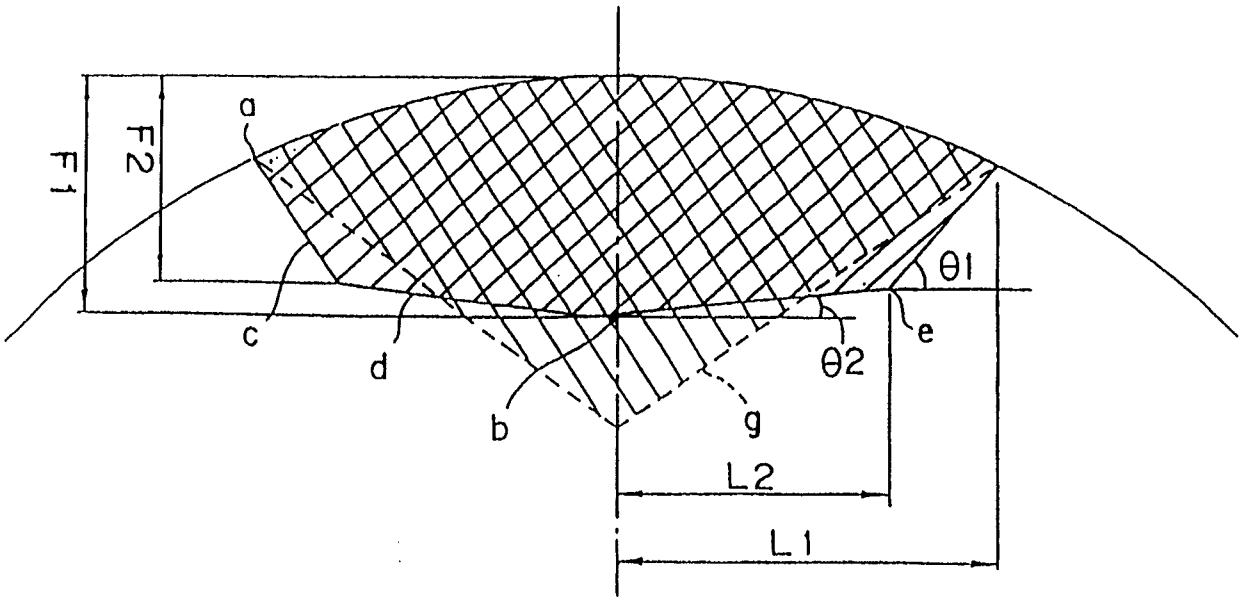
FIG. 1 is an explanatory view for describing a double slope of a polygonal dimple according to the present invention.
Figure 2:
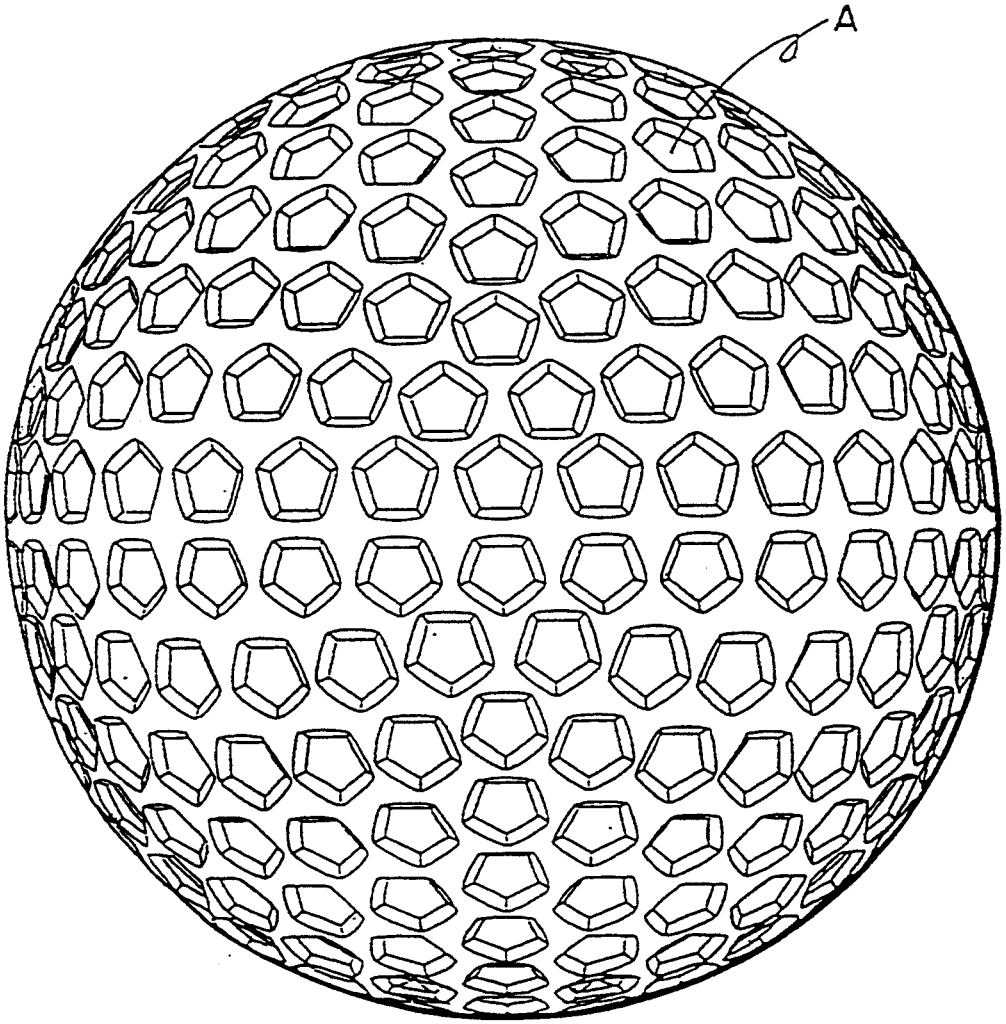
FIG. 2 is a front view showing dimples according to a first embodiment of the present invention.
Figure 3:
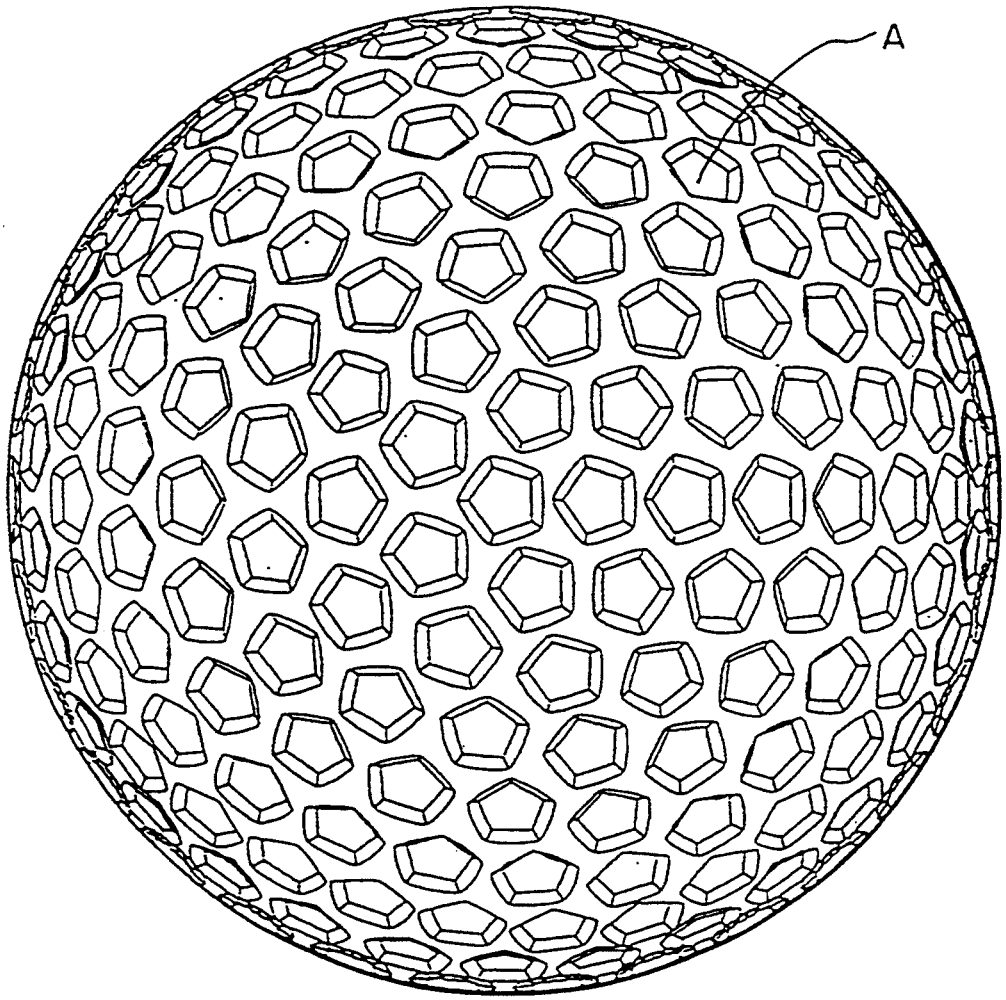
FIG. 3 is a plan view showing the dimples according to the first embodiment.

Before the description of the present invention proceeds, it is to be noted that like parts are designated by like reference numerals throughout the accompanying drawings.

Figure 4:
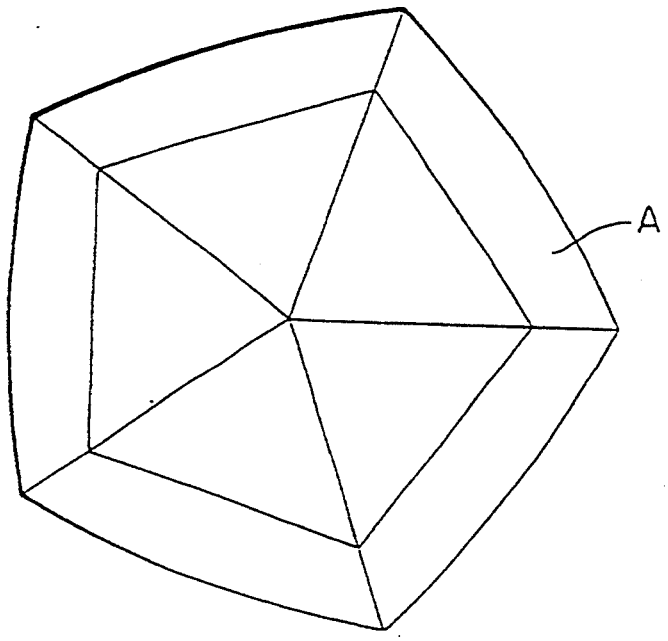
FIG. 4 is a plan view showing a dimple (A) according to the first embodiment.
Figure 5:
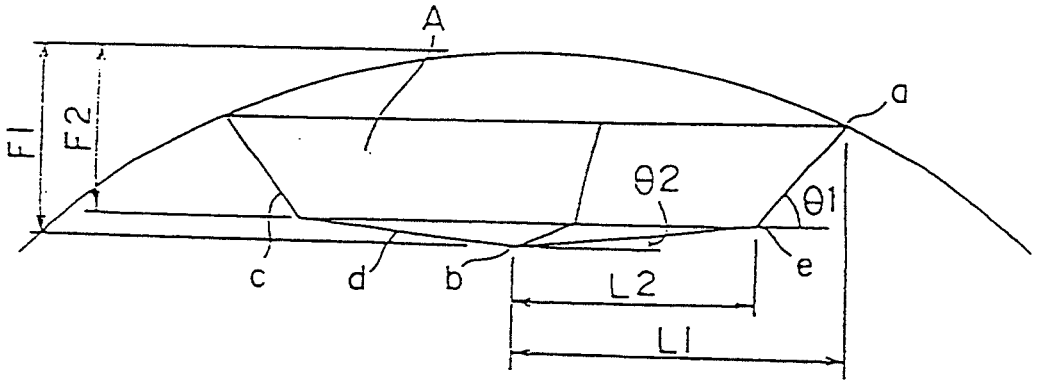
FIG. 5 is a sectional view showing the dimple (A)
Figure 6:
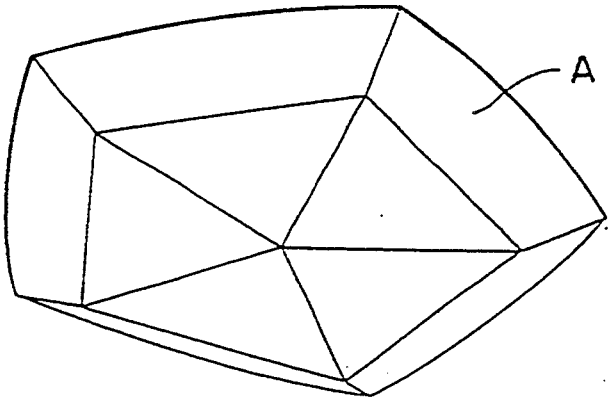
FIG. 6 is a perspective view showing the dimple (A)

A first embodiment of the present invention will be described below with reference to FIGS. 1 and 6. In the first embodiment, a golf ball has dimples being regular pentagonal and having a double slope. More specifically, as shown in FIGS. 4, 5, and 6, the golf ball has 332 dimples (A) regular pentagonal in the surface configuration thereof and doubly sloped in the sectional configuration thereof. The specification of the dimple (A) is shown in Table 1.

L1, L2, F1, F2, 1, and 2 in Table 1 show the length of each portion described previously with reference to FIG. 1. That is, as shown in FIG. 5, L1 is the horizontal length between the vertex (a) of a regular polygon and the center (b) thereof. L2 is the horizontal length between the intersection (e) of a first slope (c) with a second slope (d) and the center (b) of the regular pentagon. F1 is the depth between the imaginary spherical surface of the golf ball and the deepest point of the dimple. F2 is the vertical length between the imaginary spherical surface of the golf ball and the intersection (e) of the first slope (c) with the second slope (d).

TABLE 1

| | specification of dimple of enbodiments and conparison examples | | | | | | | |
|---|---|---|---|---|---|---|---|---|
| dimple | surface | section | L1 | L2 | F1 | F2 | r1 | r2 |
| A | reg-pen | d-slope | 2.00 | 1.48 | 0.28 | 0.23 | — | — |
| B | reg-hex | d-slope | 1.90 | 1.39 | 0.29 | 0.23 | — | — |
| C | reg-pen | s-slope | 2.00 | — | 0.24 | — | — | — |
| D | reg-hex | s-slope | 1.90 | — | 0 24 | — | — | — |
| E | circular | d-radius | 1.85 | — | 0.19 | — | 14.0 | 3.0 |

In the Table 1, L1, L2, F1, F2, r1, and r2 are shown in millimeters; surface configuration is abbreviated as surface; sectional configuration is abbreviated as section; regular pentagon is abbreviated as reg-pen; regular hexagon is abbreviated as reg-hex; double s lope is abbreviated as d-slope; single slope is abbreviated as s-slope; and double radius is abbreviated as d-radius.

The configuration of the double slope of the dimple (A) satisfies the following three conditions:

Firstly, $L2/L1 \geqq 0.6$

Secondly, $\{F2-R+(R^2-L1^2)^{\frac{1}{2}}\}/\{F1-R+(R^2-L1^2)^{\frac{1}{2}}\} \geqq 0.6$ where R is the radius of golf ball.

Thirdly, $\theta 1 > \theta 2$. The third condition is automatically satisfied if the first and second condition are satisfied. In the dimple (A), the gradient of the first slope (c) is greater than that of the second slope (d) so as to improve the effect of sweeping air away from the periphery of the golf ball.

A second embodiment of the present invention is described below with reference to FIGS. 7 through 10. The golf ball of the second embodiment has two kinds of dimples, namely, dimples regular pentagonal in the surface configuration thereof and doubly sloped in the sectional configuration thereof and dimples being circular in the surface configuration thereof and having a double radius.

Figure 9:
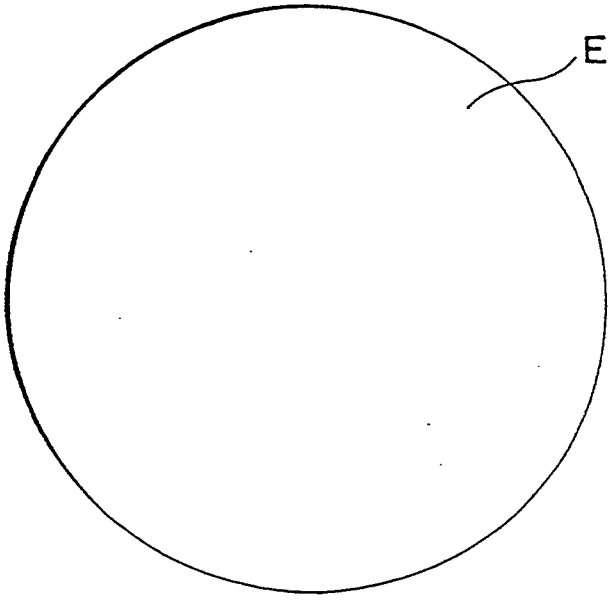
FIG. 9 is a plan view showing a dimple (E) according to the second embodiment.
Figure 7:
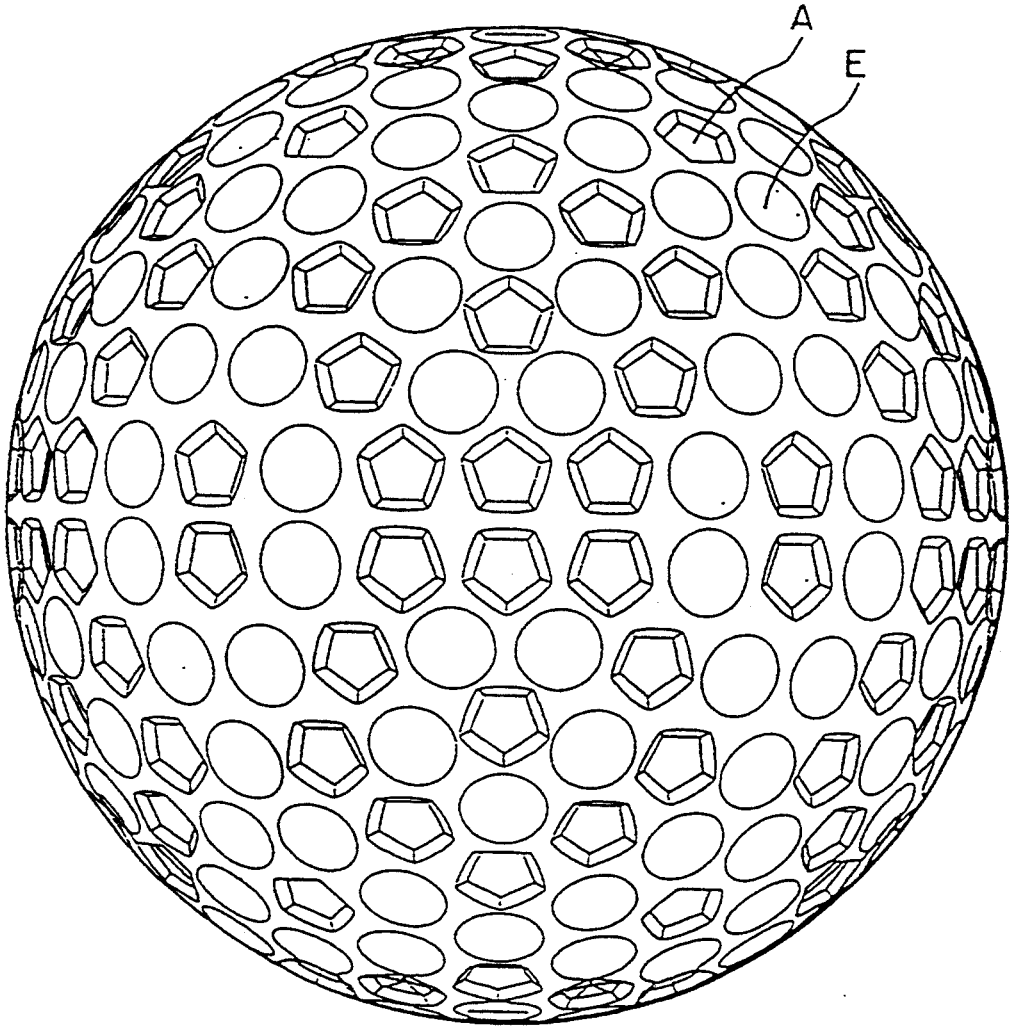
FIG. 7 is a front view showing dimples according to a second embodiment.
Figure 8:
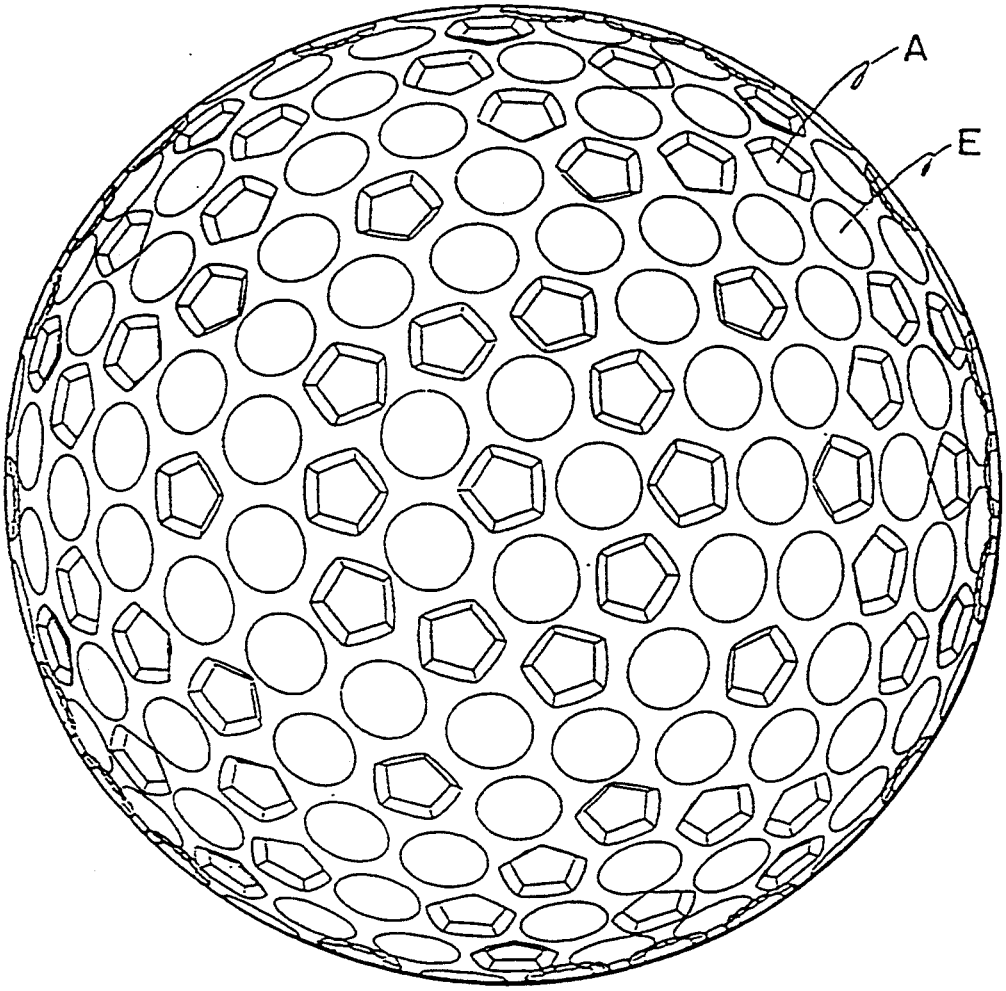
FIG. 8 is a plan view showing the dimples according to the second embodiment.
Figure 10:
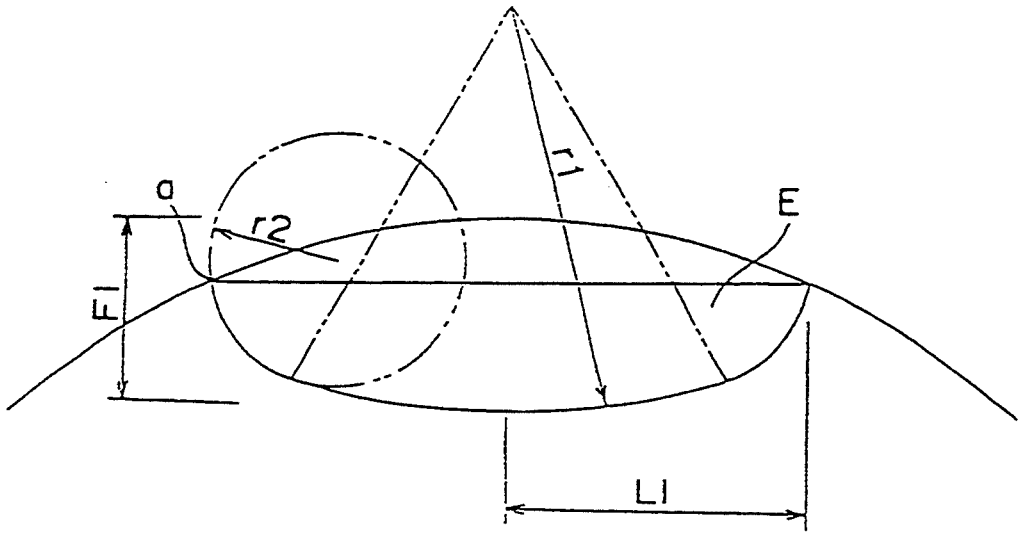
FIG. 10 is a sectional view showing the dimple (E)

That is, the golf ball has 152 dimples (A) similar to those of the first embodiment and 180 dimples (E) being circular in the surface configuration thereof and having the double radius as shown in FIGS. 9 and 10, thus having 332 dimples in total. The specification of the dimple (E) is shown in Table 1.

L1 in Table 1 shows the radius of the circular dimple (E) as shown in FIG. 10; r1 shows the curvature of the curved surface of the bottom portion of the dimple (E); and r2 shows the curvature of the curved surface in the vicinity of the edge (a) of the dimple (E).

In the dimple (E), the curvature r2 is smaller than the curvature r1. That is, the curved surface near the dimple edge (a) forms a large angle (gradient) with respect to the flow of air in the periphery of the golf ball so as to improve the aerodynamic characteristic of the golf ball.

Figure 13:
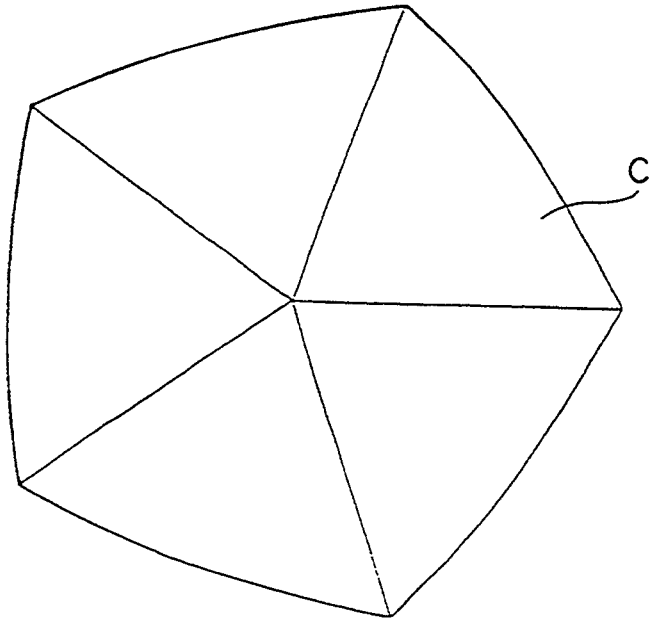
FIG. 13 is a plan view showing a dimple (C) according to the third embodiment of the present invention.
Figure 11:
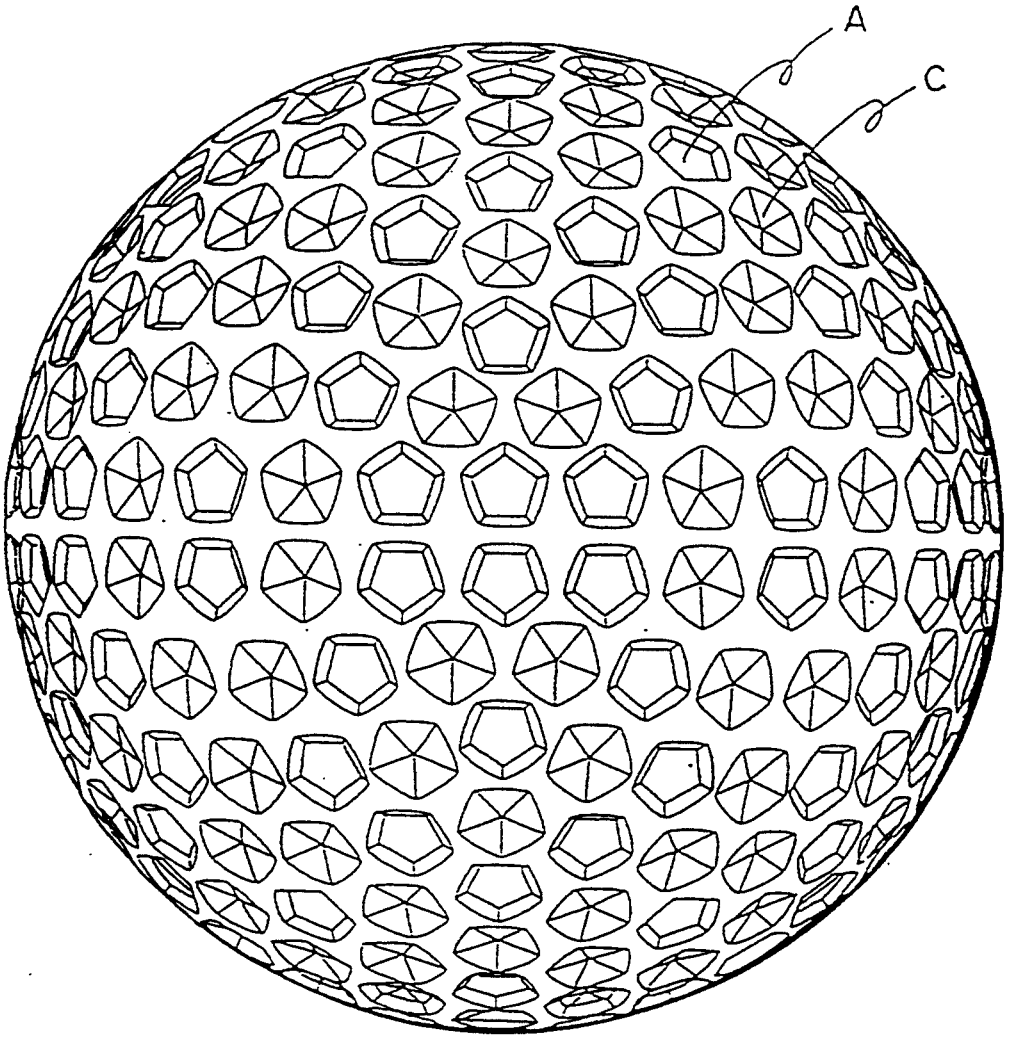
FIG. 11 is a front view showing dimples according to a third embodiment.
Figure 12:
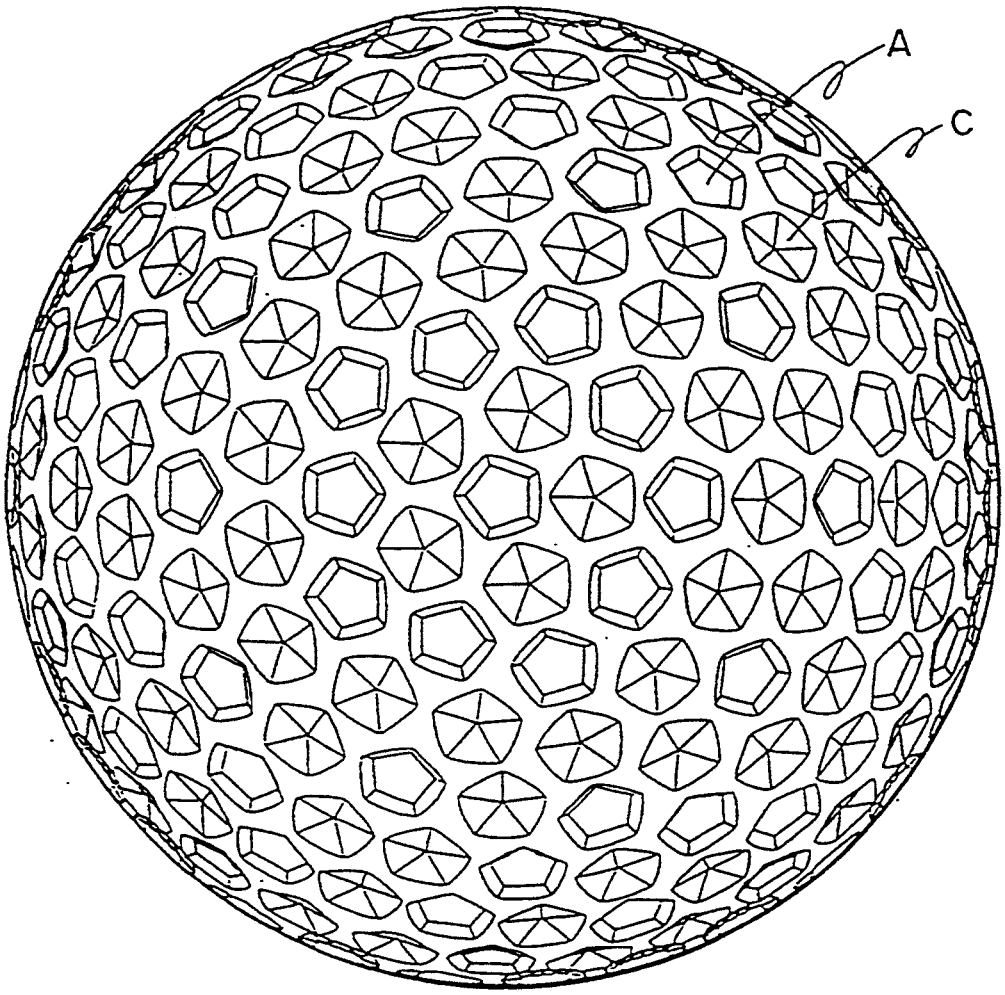
FIG. 12 is a plan view showing the dimples according to the third embodiment.

A third embodiment of the present invention is described below with reference to FIGS. 11 through 15. The golf ball of the third embodiment has dimples regular pentagonal and doubly sloped and dimples regular pentagonal and singly sloped. That is, the golf ball has 152 dimples (A) similar to the first and second embodiments and 180 dimples (C) pentagonal in the surface configuration thereof and having a single slope as shown in FIGS. 13 through 15, thus having 332 dimples in total.

Figure 14:
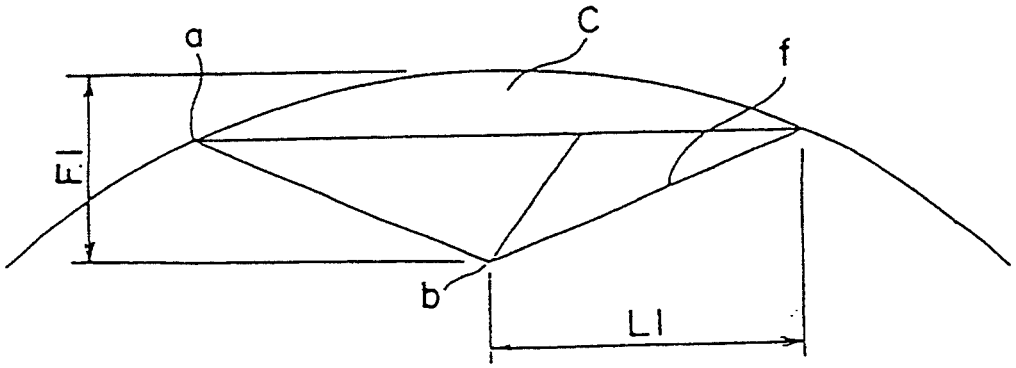
FIG. 14 is a sectional view showing the dimple (C)
Figure 15:
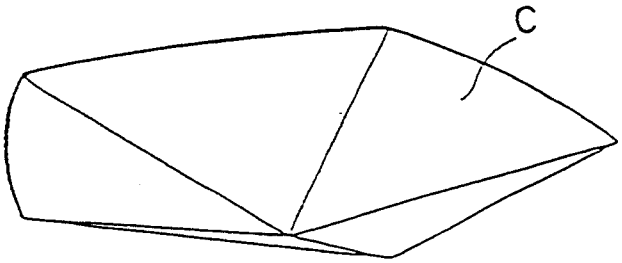
FIG. 15 is a perspective view showing the dimple (C)

The single slope configuration is sectionally straight in the line (f) connecting an edge (a) thereof and its center (b) with each other as shown in FIG. 14. The specification of the dimple (C) is shown in the above Table 1.

Figure 16:
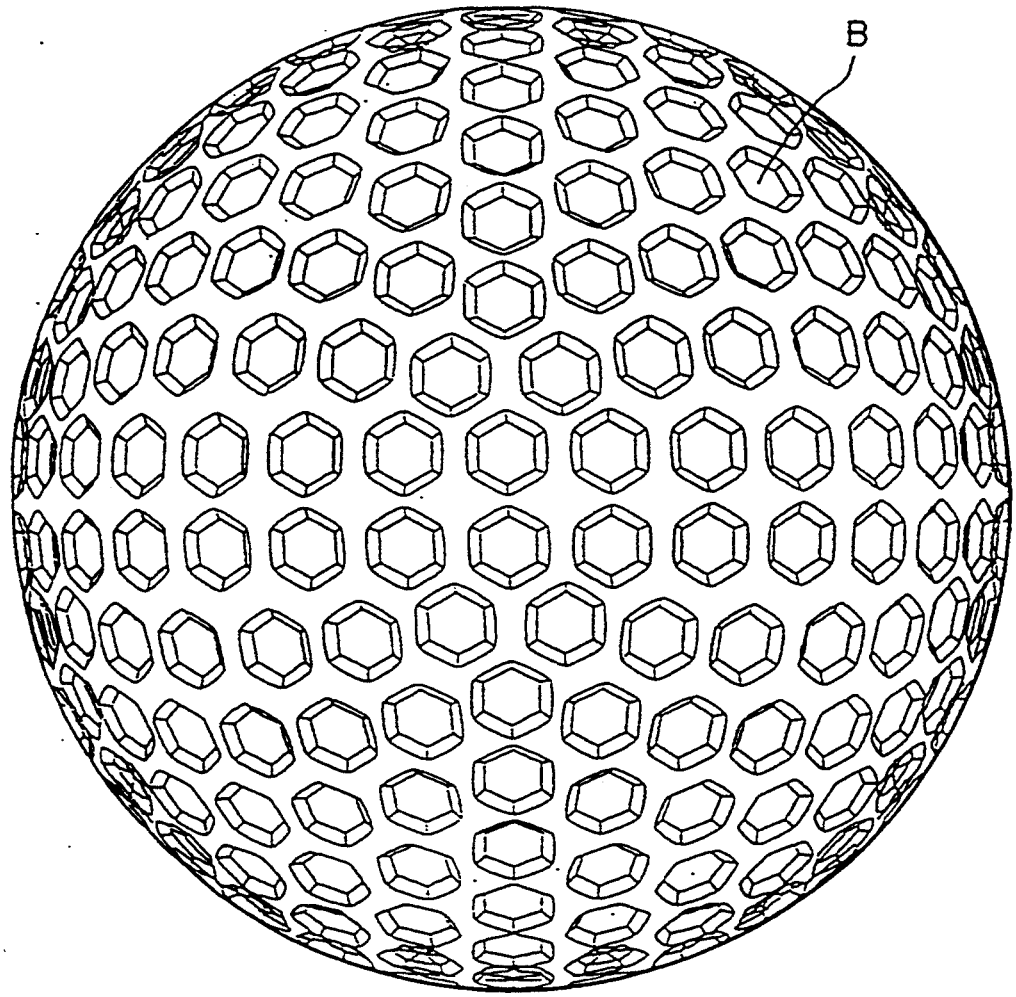
FIG. 16 is a front view showing dimples according to a fourth embodiment.
Figure 17:
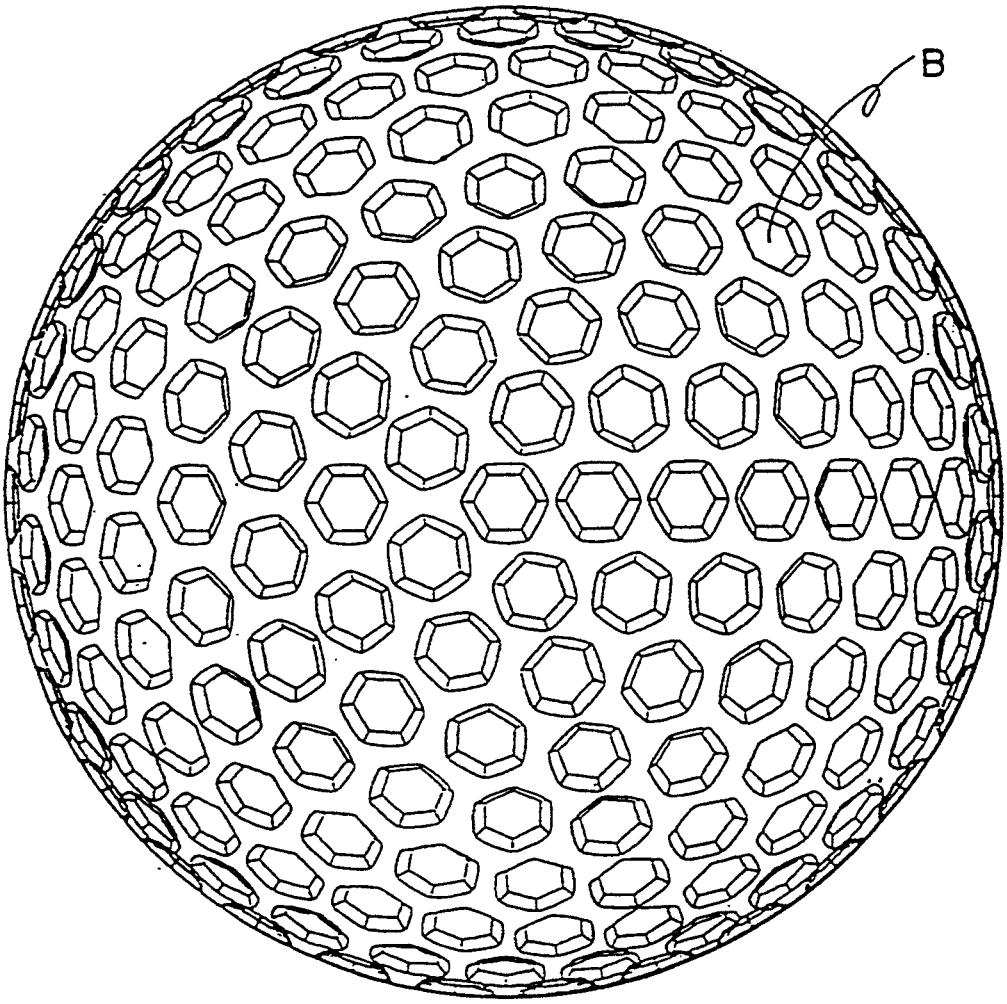
FIG. 17 is a plan view showing the dimples according to the fourth embodiment.
Figure 18:
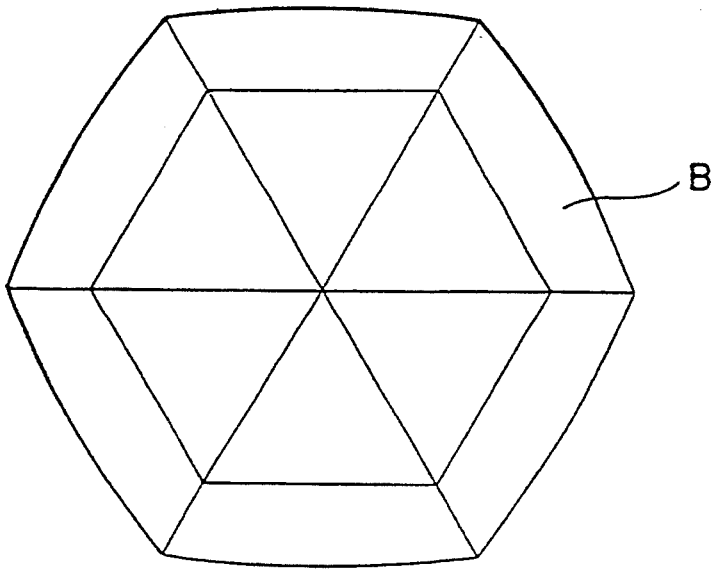
FIG. 18 is a plan view showing a dimple (B) according to the fourth embodiment.
Figure 19:
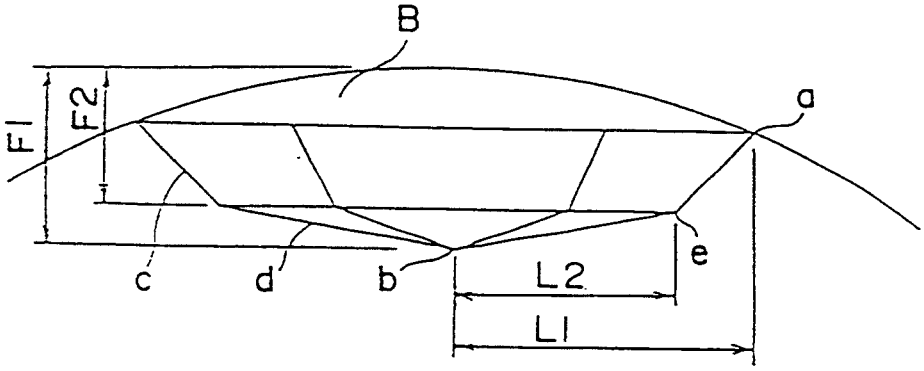
FIG. 19 is a sectional view showing the dimple (B)
Figure 20:
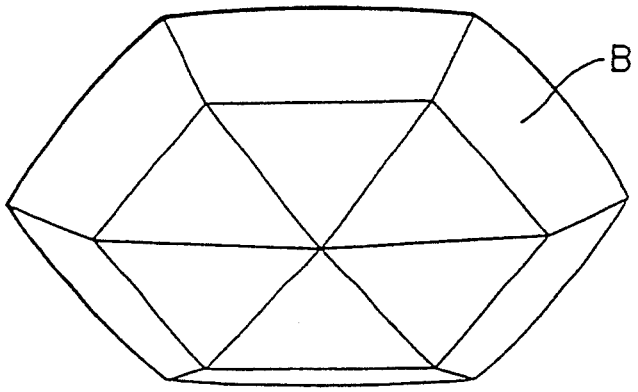
FIG. 20 is a perspective view showing the dimple (B)

A fourth embodiment of the present invention will be described below with reference to FIGS. 16 and 20. A golf ball according to the fourth embodiment has dimples regular hexagonal and doubly sloped. That is, as shown in FIGS. 18 through 20, the golf ball has 332 dimples (B) regular hexagonal in the surface configuration thereof and doubly sloped in the sectional configuration thereof. The specification of the dimple (A) is shown in the above Table 1. The dimple (B) satisfies the above-described three conditions similarly to the dimple (A). That is, the gradient of a first slope (c) is greater than that of a second slope (d) so as to obtain the effect of sweeping air away from the periphery of the golf ball.

Figure 21:
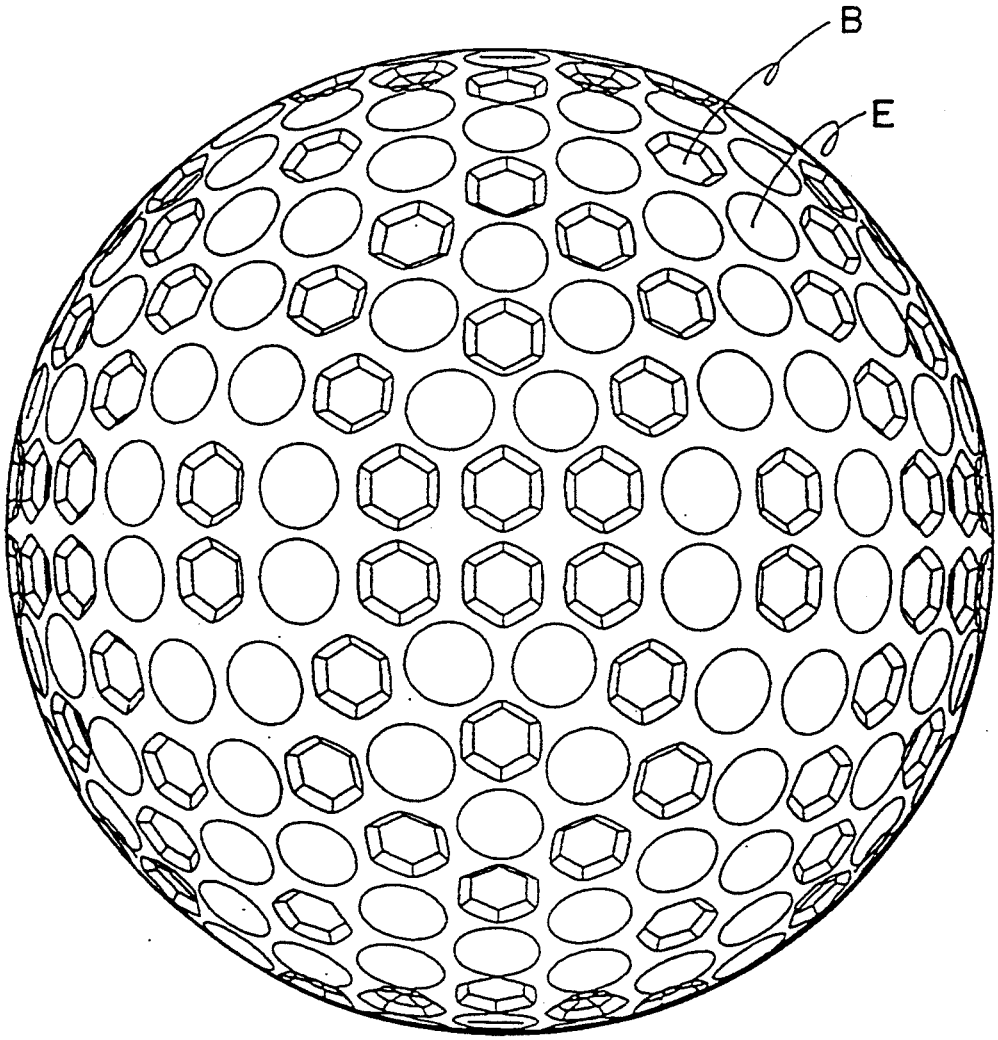
FIG. 21 is a front view showing dimples according to a fifth embodiment.
Figure 22:
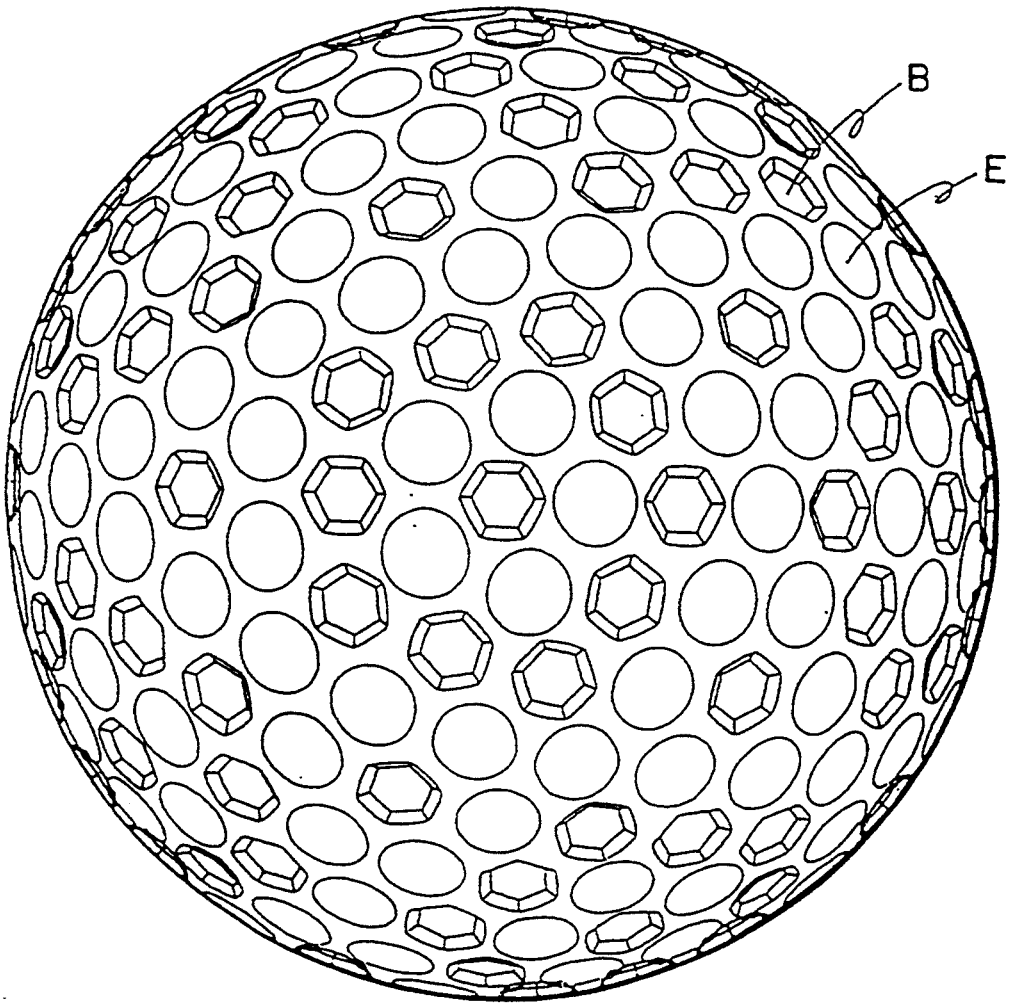
FIG. 22 is a plan view showing the dimples according to the fifth embodiment.
Figure 23:
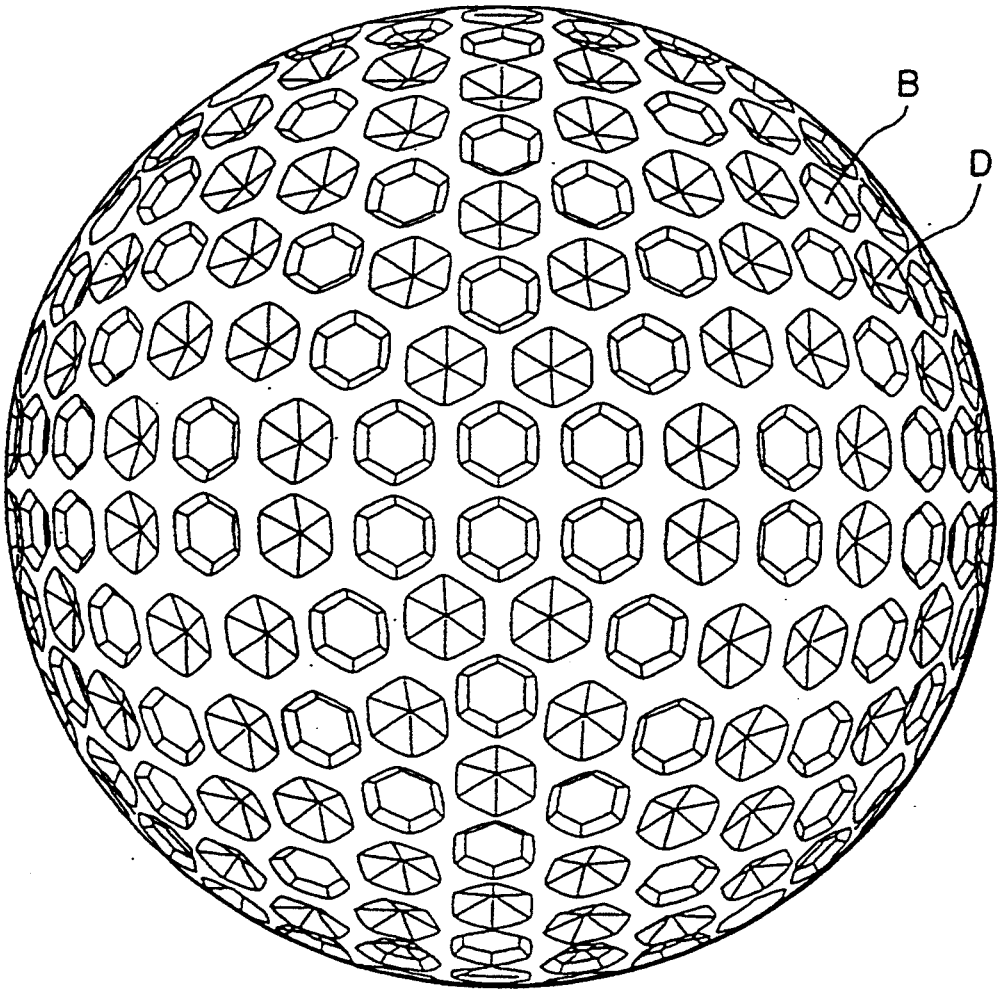
FIG. 23 is a front view showing dimples according to a sixth embodiment.
Figure 24:
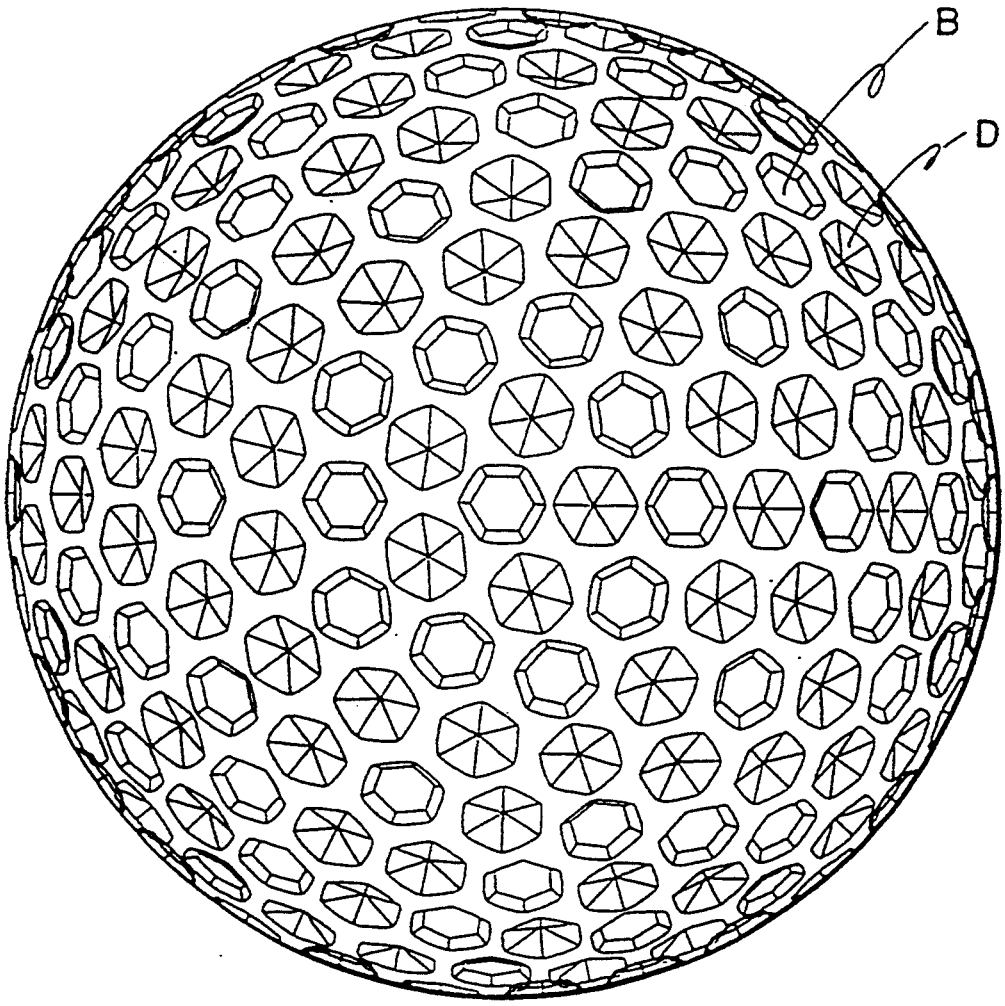
FIG. 24 is a plan view showing the dimples according to the sixth embodiment.

A fifth embodiment of the present invention is described below with reference to FIGS. 21 and 22. The golf ball of the fifth embodiment has two kinds of dimples, namely, 152 dimples (B) regular hexagonal in the surface configuration thereof and doubly sloped in the sectional configuration thereof similarly to the fourth embodiment and 180 dimples (E) being circular in the surface configuration thereof and having a double radius similarly to the second embodiment, thus having 332 dimples in total.

Figure 25:
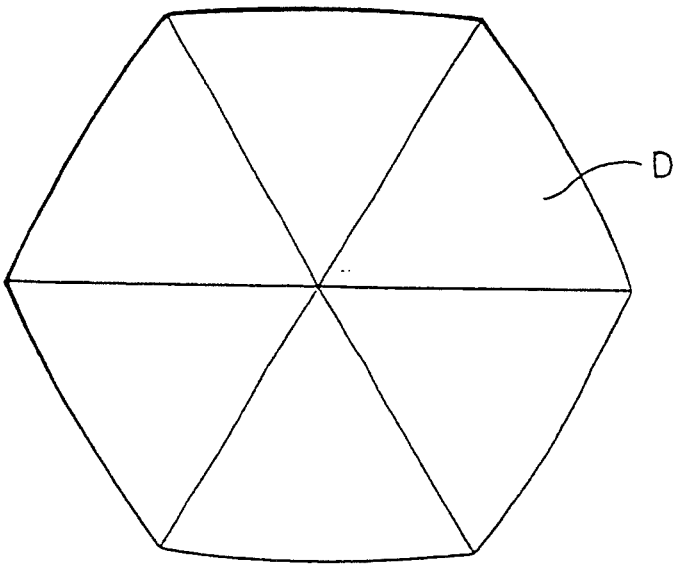
FIG. 25 is a plan view showing a dimple (D) according to the sixth embodiment.
Figure 26:
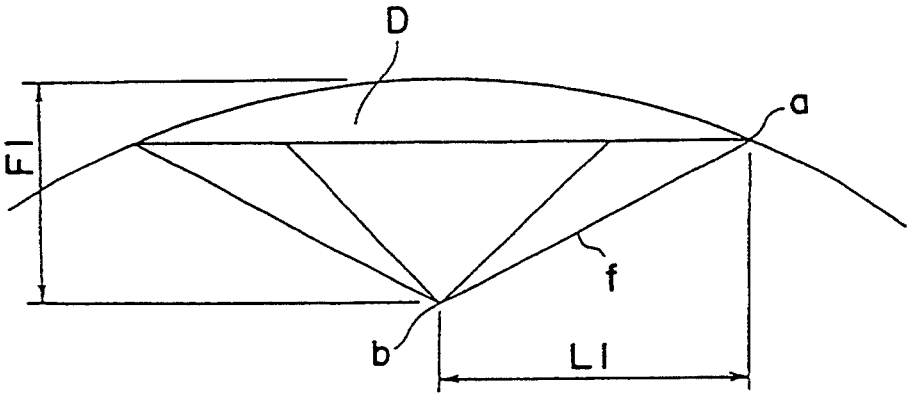
FIG. 26 is a sectional view showing the dimple (D)
Figure 27:
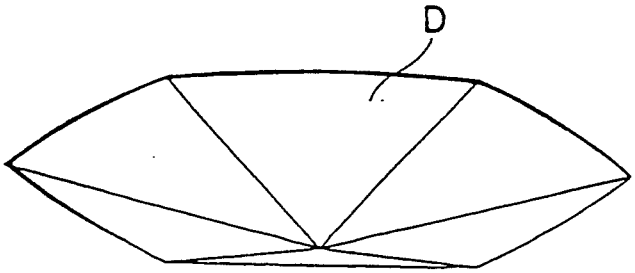
FIG. 27 is a perspective view showing the dimple (D)

A sixth embodiment of the present invention is described below with reference to FIGS. 23 through 27. The golf ball according to the sixth embodiment has dimples regular hexagonal in the surface configuration thereof and doubly sloped in the sectional configuration thereof and dimples regular hexagonal in the surface configuration thereof and singly sloped in the sectional configuration thereof. That is, the golf ball has 152 dimples (B) regular hexagonal in the surface configuration thereof and doubly sloped in the sectional configuration thereof similarly to the fourth and fifth embodiments and 180 dimples (D) regular hexagonal in the surface configuration thereof and singly sloped (shown-by (f) in FIG. 26) as shown in FIGS. 25, 26, and 27, thus having 332 dimples in total. The specification of the dimple (D) is shown in Table 1.

Golf balls of first through third comparison examples were prepared to examine the effect of the dimple (A) through the dimple (E) of the first through sixth embodiment.

Figure 28:
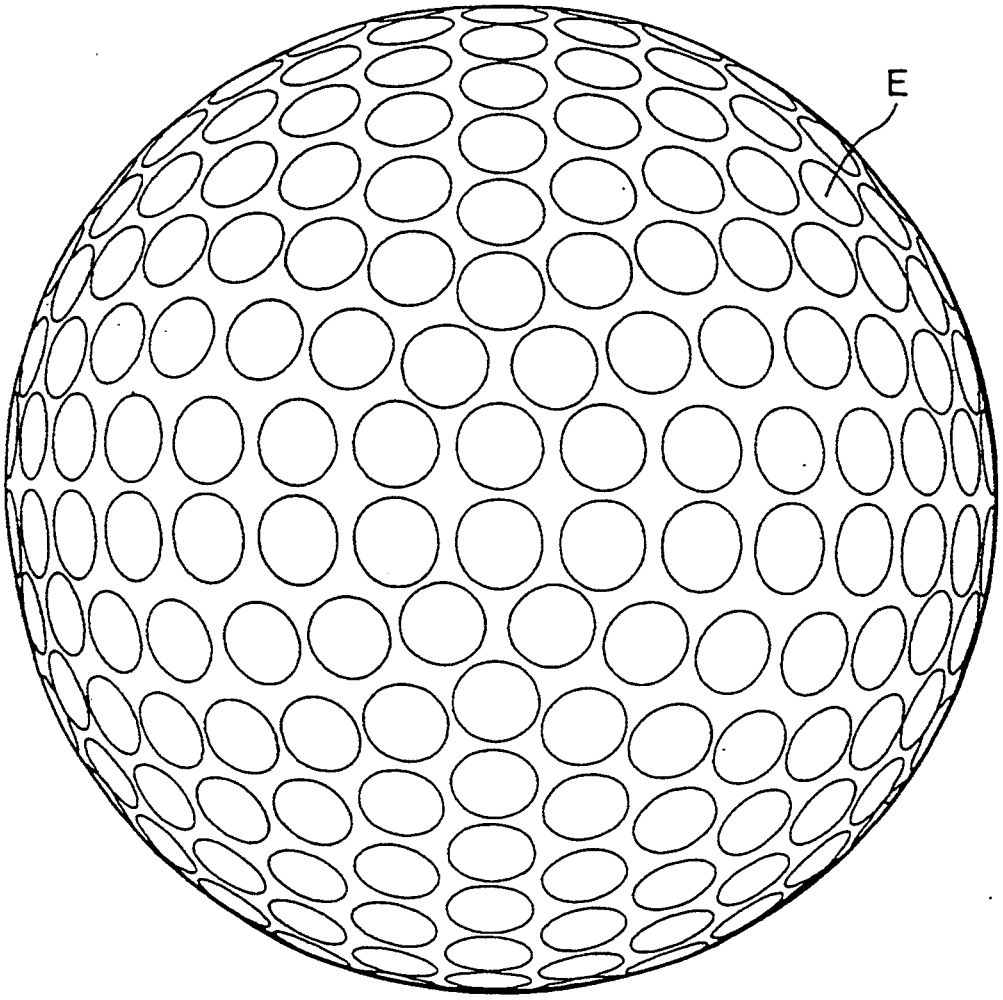
FIG. 28 is a front view showing dimples according to a first comparison example.
Figure 29:
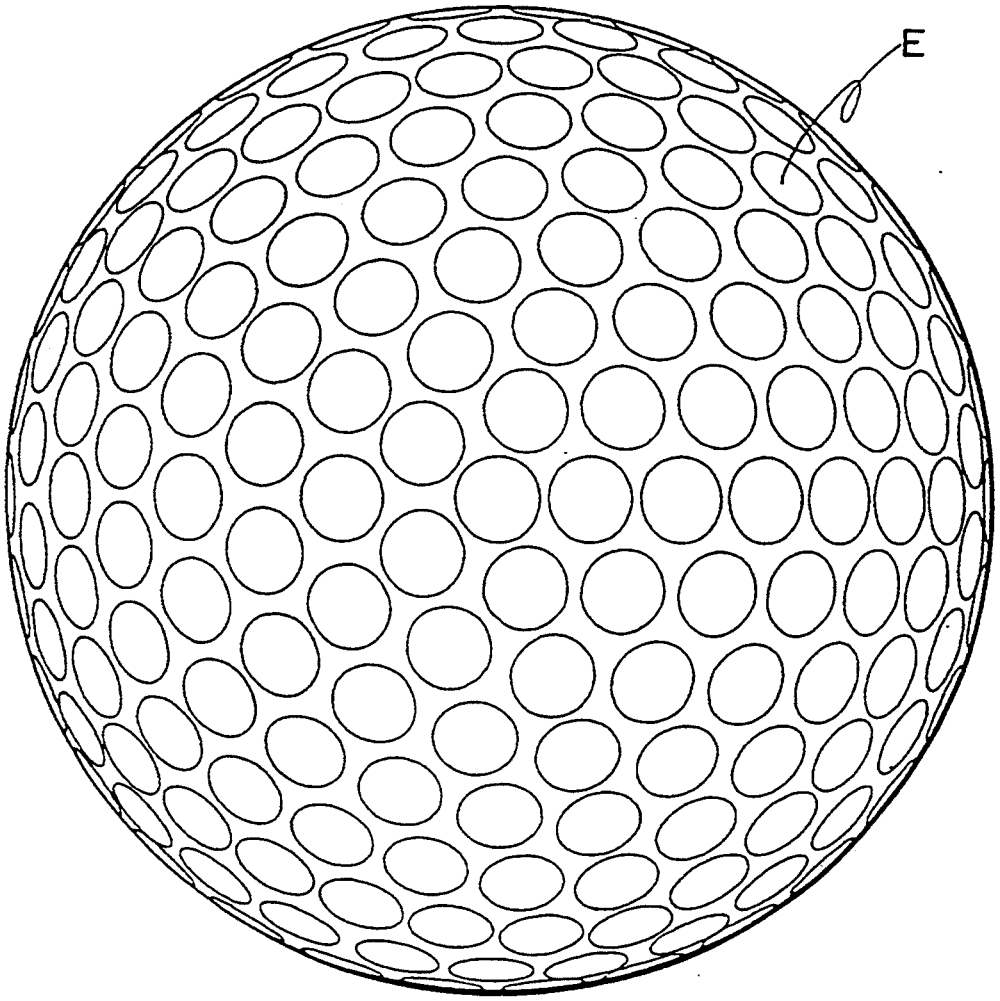
FIG. 29 is a plan view showing the dimples according to the first comparison example.

FIGS. 28 and 29 show the golf ball of the first comparison example. The golf ball has 332 dimples (E) being circular in the surface oonfiguration thereof and having a double radius similarly to the dimples of the second and fifth embodiments.

Figure 30:
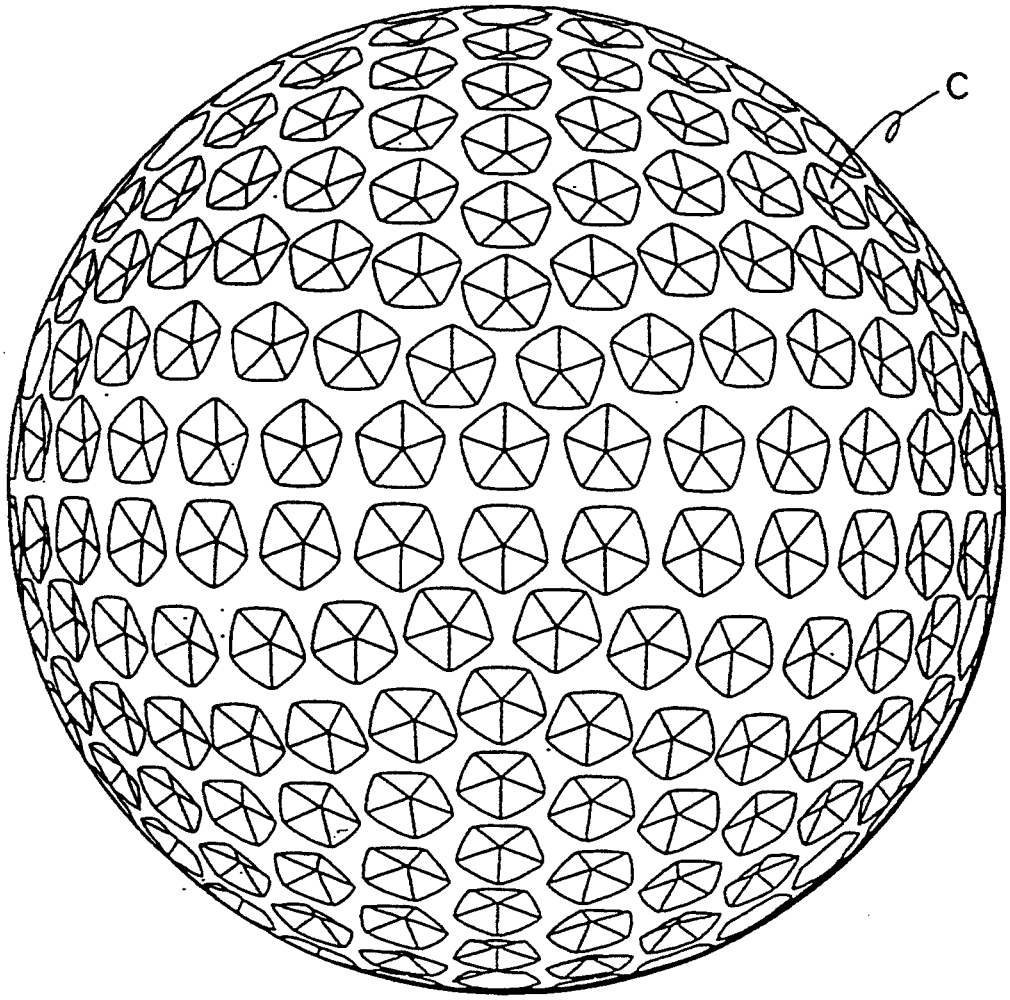
FIG. 30 is a front view showing dimples according to a second comparison example.
Figure 31:
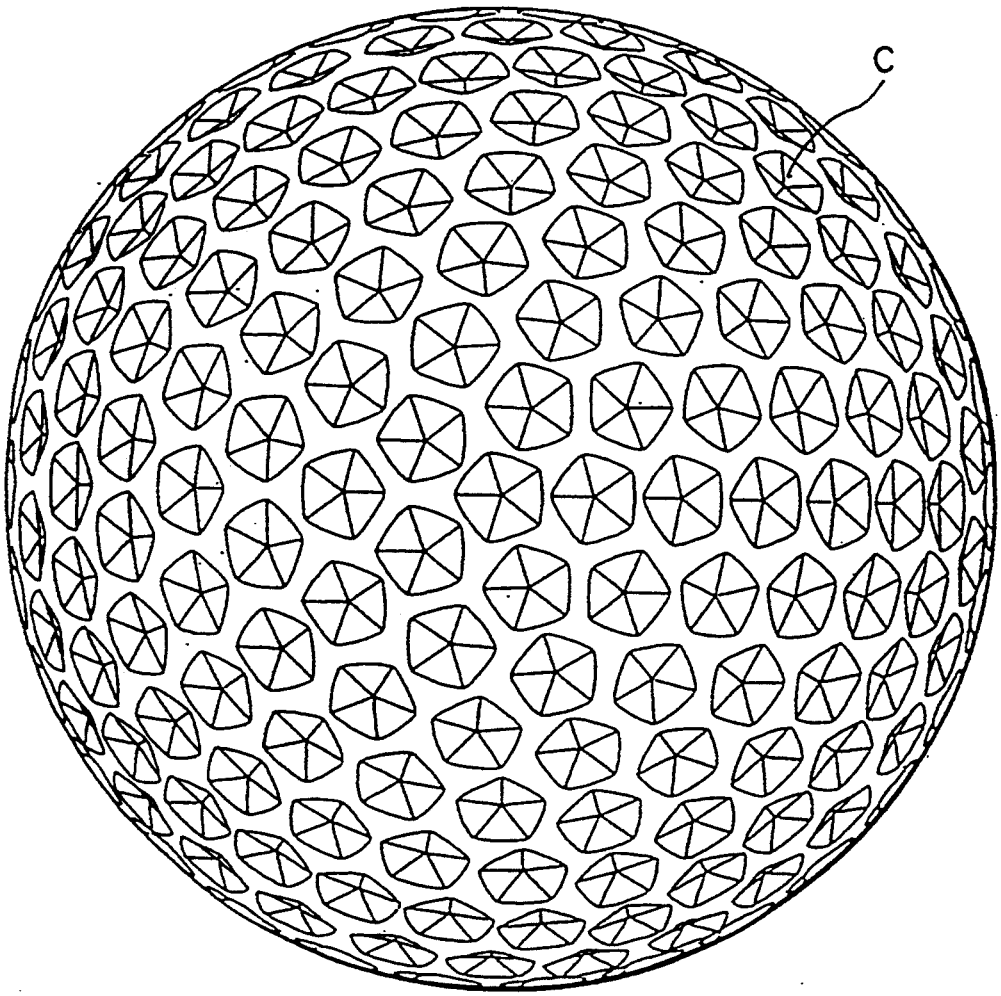
FIG. 31 is a plan view showing the dimples according to the second comparison example.

FIGS. 30 and 31 show the golf ball of the second comparison example. The golf ball has 332 dimples (C) regular pentagonal in the surface configuration thereof and singly sloped in the sectional configuration thereof similarly to the dimple of the third embodiment.

Figure 32:
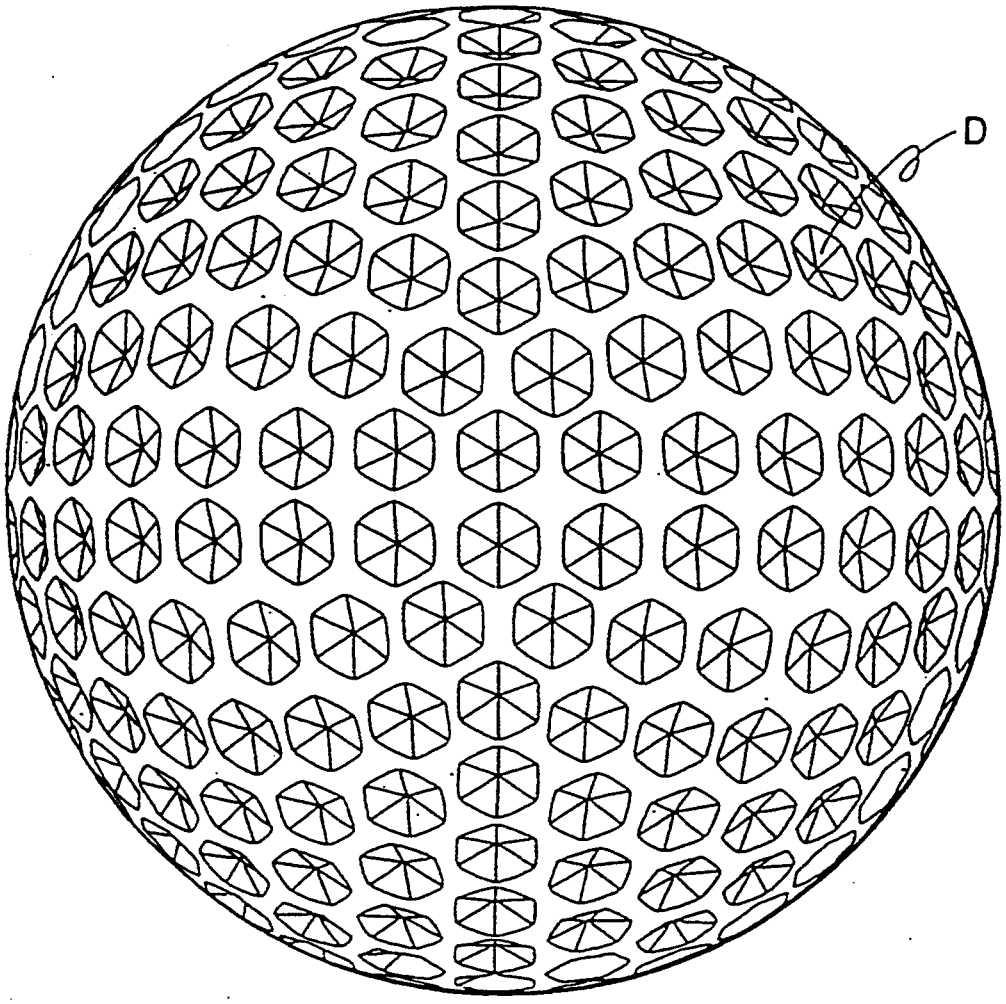
FIG. 32 is a front view showing dimples according to a third comparison example.
Figure 33:
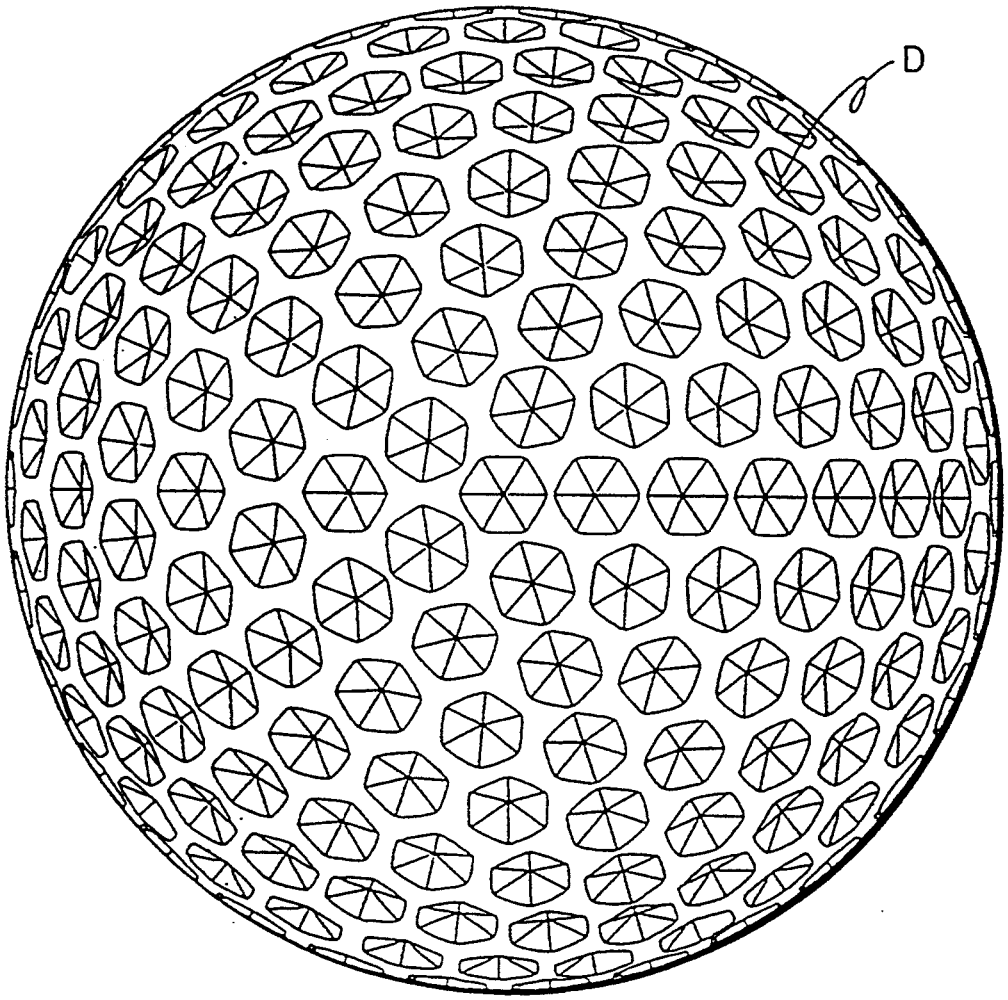
FIG. 33 is a plan view showing the dimples according to the third comparison example.

FIGS. 32 and 33 show the golf ball of the third comparison example. The golf ball has 332 dimples (D) regular hexagonal in the surface configuration thereof and singly sloped in the sectional configuration thereof similarly to the dimple of the sixth embodiment.

The golf balls of the first through sixth embodiment and those of the first through third comparison example were all thread-wound and had a balata cover and a liquid center, respectively. They had the same construction and composition. The outer diameters thereof were all 42.70±0.03 mm and the compression thereof were all 95±2. Every golf balls had an icosahedral arrangement which has been widely adopted as a dimple-arranging pattern, and 332 dimples.

The experimental results of the first through sixth embodiment and those of the first through third comparison example are described below. Using a swing robot manufactured by "True Temper Corp., the golf balls of the first through sixth embodiment and those of the first through the third comparison example were shot by a driver (W1) at a head speed of 45m/sec to measure the flight distance of each golf ball. The spin was 3500±300 rpm and the angle of flight for the ball was 10 ±0.5°. The golf balls were kept at a temperature of 23±1° C. in an oven until they were shot. Wind blew at a speed of 1.1 to 2.8 m/sec in the direction from the right. Table 2 shows the average of the test result of 20 golf balls used for each of the first through sixth embodiment and the first through third comparison example.

TABLE 2

| | dimple of embodiments and comparison examples and test result of flight distance | | | | | |
|---|---|---|---|---|---|---|
| | | | test result of flight distance | | | |
| | dimple | | carry (yard) | run (yard) | total (yard) | trajectory height (DEG) |
| 1E | A(req.pen.)(d.sl.) | 332 | 227.4 | 12.5 | 239.9 | 13.3 |
| 2E | A(reg.pen.)(d.sl.) | 152 | 222.5 | 12.9 | 235.4 | 12.7 |
| | B(c.)(d.r.) | 180 | | | | |
| 3E | A(reg.pen.)(d.sl.) | 152 | 223.0 | 13.5 | 236.5 | 13.0 |
| | C(reg.pen.)(s.sl.) | 180 | | | | |
| 4E | B(reg.hex.)(d.sl.) | 332 | 226.9 | 12.4 | 239.3 | 13.2 |
| 5E | B(reg.hex.)(d.sl.) | 152 | 222.0 | 13.1 | 235.1 | 12.5 |
| | E(c.)(d.r.) | 180 | | | | |
| 6E | B(reg.hex.)(d.sl.) | 152 | 222.2 | 13.6 | 235.8 | 13.1 |
| | D(reg.hex.)(s.sl.) | 180 | | | | |
| 1C | E(c.)(d.r.) | 332 | 216.3 | 13.2 | 229.5 | 12.2 |
| 2C | C(reg.pen.)(s.sl.) | 332 | 218.2 | 14.7 | 232.9 | 11.9 |
| 3C | D(reg.pen.)(s.sl.) | 332 | 218.5 | 14.5 | 233.0 | 12.2 |

In the Table 2, embodiment is abbreviated as E, 1E is first embodiment, 2E is second embodiment, 3E is third embodiment, 4E is fourth embodiment, 5E is fifth embodiment and 6E is sixth embodiment; comparison example is abbreviated as c, 1C is first comparison, 2C is second comparison and 3C is third comparison; regular pentagonal is abbreviated as (reg.pen.); double slope is abbreviated as (d.sl.); circular is abbreviated as (c.); single slope is abbreviated as (s.sl.); regular hexagonal is abbreviated as (reg.hex.); double radius is abbreviated as (d.r.). Further, in the Table 2, carry is the distance from the shot point to the drop point; total is the distance from the shot point to the stop point; run is the difference between total and carry; and trajectory height is an angle of elevation foxyned between the horizontal line and the straight line connecting the ball-hitting point with the highest point of the golf ball in trajectory.

As shown in Table 2, the golf balls of the first and fourth embodiments having dimples of only double-slope configuration had a longest carry. The golf balls of the second, third, fifth, and sixth embodiments having 152 dimples (46% of all dimples) of the double-slope configuration had a second longest carry. The golf balls of the first to third comparison example on which dimple of double-slope configuration were not foilned had a shortest carry. The test results indicate that the double-slope configuration causes the golf ball to have a favorable aerodynamic characteristic.

The advantage of the double-slope configuration is that as described previously, a plane having a large angle with respect to the flow of air in the periphery of the golf ball is formed in the vicinity of an edge of a polygonal dimple. The greater the angle of the plane, namely, the gradient of the plane is, the greater is the effect of sweeping air away from the periphery of the golf ball. In view of the fact that the diameter and volume of the dimple are limited to a certain range, the gradient in the vicinity of the dimple edge cannot be made to be large in the case of the single-slope configuration while the gradient in the vicinity of the dimple edge can be made to be great in the case of the double-slope configuration.

The characteristic configuration of the dimple according to the present invention is polygonal in the surface configuration thereof, but the dimple of a regular polygonal configuration is more favorable than that of a polygonal configuration. This is because the regular polygonal dimple has the effect of sweeping air away from the golf ball equally in every spin direction of the golf ball.

As apparent from the foregoing description, the dimple is polygonal in the surface configuration thereof and has a double slope in the sectional configuration thereof. Therefore, the dimple has a striking effect of sweeping air away from the periphery of the golf ball and making the air flow very turbulent. Thus, the dimple improves the aerodynamic characteristic of the golf ball. The golf ball according to the present invention has dimples in the above-described configuration at more than 40% of all dimples thereof. Therefore, the golf ball has an improved flight performance and hence a long flight distance.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

We claim:

1. A golf ball having a plurality of dimples on a surface thereof characterized in that more than 40% of all dimples are polygonal in shape and have a double slope in section having a straight first slope and a straight second slope continued radially inwardly from the first slope, and the gradient of the first slope of said double slope disposed in the vicinity of a dimple edge is greater than that of the second slope disposed in the vicinity of the bottom thereof.

2. The golf ball as claimed in claim 1, wherein said polygonal configuration is regular polygonal.

3. The golf ball as claimed in claim 1, wherein said polygonal configuration is regular pentagonal or regular hexagonal.

4. The golf ball as claimed in claim 1, wherein a ratio of L1 which is a horizontal length between a vertex of said dimple and a center thereof to L2 which is a horizontal length between the intersection of a first slope with a second slope in said double slope and the center of the dimple is $L2/L1 \geqq 0.6$.

5. The golf ball as claimed in claim 1, wherein a following equation is established, and in the equation, F1 is a distance between the imaginary spherical surface of said golf ball and the deepest point of the dimple, F2 is a vertical length between the imaginary spherical surface of said golf ball and the intersection of the first slope with the second slope, L1 is a horizontal length between a vertex of said dimple and a center thereof to L2 which is a horizontal length between the intersection of a first slope with a second slope in said double slope and R is a radius of the golf ball.

$$\{F2-R+(R^2-L1^2)^{1/2}\}/\{F1-R+(R^2-L1^2)^{1/2}\} \geqq 0.6.$$

* * * * *